US005537806A

United States Patent [19]

Grierson et al.

[11] Patent Number: 5,537,806

[45] Date of Patent: Jul. 23, 1996

[54] BAG SEALING APPARATUS AND RELATED METHOD FOR SEALING BAGS

[75] Inventors: Raymond J. Grierson, Cordova, Tenn.; Robert Steinberger, Little Suamico, Wis.

[73] Assignee: International Paper Company, Purchase, N.Y.

[21] Appl. No.: 395,723

[22] Filed: Feb. 28, 1995

[51] Int. Cl.[6] ..... B65B 7/20

[52] U.S. Cl. ..... 53/491; 53/376.4; 53/376.5; 53/377.2; 53/377.4

[58] Field of Search ..... 53/491, 376.3, 53/376.4, 376.5, 461, 480, 230, 231, 377.2, 377.4, 370.6, 386.1

[56] References Cited

U.S. PATENT DOCUMENTS

| | | | |
|---|---|---|---|
| 1,873,060 | 8/1932 | Smith | 53/230 |
| 2,014,555 | 9/1935 | Chekian | 93/6 |
| 2,584,529 | 2/1952 | Allen | 53/148 |
| 3,060,659 | 10/1962 | Blais et al. | 53/186 |
| 3,213,591 | 10/1965 | Feurstein et al. | 53/379 |
| 3,237,373 | 5/1966 | Lewis | 53/378 |
| 3,253,389 | 5/1966 | Miller et al. | 53/376.5 |
| 3,465,490 | 9/1969 | Mahncke | 53/38 |
| 3,579,948 | 5/1971 | Lerner | 53/29 |
| 3,869,846 | 3/1975 | Timmerberl | 53/230 |
| 3,956,874 | 5/1976 | Vickers et al. | 53/376.4 |
| 4,159,610 | 7/1979 | Langen | 53/377.2 |
| 4,248,032 | 2/1981 | Woods et al. | 53/386.1 |
| 4,386,923 | 6/1983 | Okushita | 53/491 |
| 4,480,421 | 11/1984 | Rece | 53/376.5 |
| 4,894,104 | 1/1990 | Hemers | 53/491 |

*Primary Examiner*—John Sipos
*Assistant Examiner*—Gene L. Kim
*Attorney, Agent, or Firm*—Ostrager, Chong & Flaherty

[57] ABSTRACT

An apparatus for sealing bags having an open end and being particularly suited for packaging diapers. The apparatus having application in line with a diaper production and bag filling machine. The open end has a pair of horizontal lips and a pair of vertical lips. An infeed conveyor intermittently conveys each one of the bags in turn from an existing production line to a sealing station. In the sealing station, advancing means continuously advance the bags past an alignment section, a vacuum and side tucking section, adhesive application sections, and folding sections. The vacuum section holds the horizontal lips in an open position while the side tucking section tucks in each of the vertical lips to form side tucks and an upper and lower horizontal flap.

21 Claims, 4 Drawing Sheets

BAG SEALING APPARATUS AND RELATED METHOD FOR SEALING BAGS

FIELD OF THE INVENTION

The present invention generally relates to packaging products such as diapers. In particular, the invention relates to an apparatus and method for automatically folding and sealing the open end of a package after the package has been filled with product and incorporating the apparatus into existing production and packaging lines.

BACKGROUND OF THE INVENTION

Conventional bags or sacks used for packaging products such as diapers are typically formed from a paperboard or plastic blank assembled in a rectangular open-ended configuration. The bags are filled with their package contents either manually or automatically in the production line. A separate sealing station is then employed to fold the open ends and seal them with an adhesive. Typical sealing systems comprise a complex combination of conveyors, folding mechanisms, tucking mechanisms, glue nozzles or brushes, motors, and cams to accomplish the folding and sealing of a package's open end. These types of systems therefore cannot be easily installed and incorporated into existing production lines and cannot accommodate bags having a broad range of sizes. Further, conventional systems typically produce packages having tucks and folds which are not precise causing poor quality seals.

Several attempts have been made in the prior art to overcome the problems of conventional sealing machines. For example, U.S. Pat. No. 3,213,591 to Feurstein et al. discloses an apparatus and method for folding and sealing the open end of a container after it has been filled with merchandise. In accordance with this disclosure, a swinging tucking member is used for tucking the container's sides to form top and bottom flaps, and a curved slot is used to fold the top flap down and the bottom flap up. An adhesive is applied during tucking and folding and the apparatus is adjustable to accommodate packages of different sizes.

U.S. Pat. No. 2,584,529 to Allen discloses a bag folding and sealing machine comprising a complex system of swinging tuck plates, folding rods, and cams and followers. The conveying mechanism in this reference temporarily stops at various points during the sealing process.

However, the prior art has not provided a satisfactory bag sealing system specifically adapted to automatically sealing the open end of a filled bag or sack as it comes directly off an existing production and packaging line. Conventional systems are not capable of producing consistent folds to form high quality seals or of quickly and easily adapting to various bag sizes.

SUMMARY OF THE INVENTION

Accordingly, it is a broad object of the present invention to overcome the aforementioned shortcomings of conventional bag sealing machines. In particular, it is an object of the present invention to provide an automatic bag sealing machine which can be readily installed and incorporated into existing production and packaging lines.

It is a further object to provide a bag sealing method and apparatus which produces consistent folds and high quality seals without using a complex combination of parts.

Another object of the invention is to provide an apparatus and method for quickly and easily sealing filled bags which can accommodate bags having a broad size range.

The present invention accomplishes the foregoing by providing an automatic bag sealing machine which transports product-filled bags having a sealed end and an open end directly from existing production and packaging lines and transfers them to an improved sealing station. The open ends each have horizontal and vertical lips which extend past the edge of the product and past the edge of the advancing means in the sealing station. In the sealing station, an easily adjustable guide rail and top conveyor are provided to accommodate bags having a broad range of sizes and a lower flighted conveyor is provided to continuously advance the bags in a horizontal direction. To ensure precise tucking and folding of the bags' open ends, a pair of vacuum conveyors having perforated belts are horizontally mounted and spaced apart such that the bags' open ends pass therebetween. Suction is provided through the belts' perforations to force the open ends' upper and lower horizontal lips against the belts and to maintain them in this open parallel position while the vertical lips are tucked in, thereby forming upper and lower horizontal flaps having precise and high quality folds.

In accordance with a preferred embodiment of the bag sealing apparatus, infeed conveyor means is provided for intermittently conveying filled open-ended bags from an existing bag production and filling line to a sealing station, which includes an alignment section, vacuum section, side tucking section, two glue application sections, and a folding side-rail section all along a continuous production line. An adjustable stopping means is provided at the end of the infeed conveyor means to stop each bag when it reaches an entry point to the sealing station appropriate for that size bag. A first pushing means is then signaled to push the bag onto a bag advancing means having flights for spacing the bags which continuously conveys the bags through each section of the sealing station.

In the alignment section, a pair of brushes and a second pushing means are provided to maintain control of the bags and to position the sealed end of each advancing bag against an adjustable guide rail which runs the length of the sealing station and is aligned with the stopping means. A pair of vacuum conveyors then forces the top and bottom horizontal lips open to ensure even spacing while the leading and trailing vertical lips are tucked in by a stationary tuck bar and a swinging tuck bar respectively to form two side tucks and top and bottom horizontal flaps.

Glue nozzles are positioned to apply a vertical series of beads of hot-melt glue to each side tuck. A folding board having a declining edge then gradually folds and presses the top horizontal flap down against the side tucks and a second glue nozzle applies a horizontal series of beads of hot-melt glue to the outer surface of the top flap. A second folding board having a inclining edge then gradually folds the bottom flap up and presses it against the top flap and a vertically disposed pressing conveyor provides additional compression to complete the sealing process. An additional conveying means may also be provided for transporting the sealed bags from the sealing station to a packing table or an automatic case packing machine for boxing and preparation for shipment. Movement of each bag is monitored by a plurality of sensors connected to a programmable logic controller, which activates each section when a bag is positioned therein.

The present invention further encompasses a method for automatically sealing the open end of a filled bag, the open end having a pair of horizontal lips and a pair of vertical lips extending past the product filled inside. The method comprises the following steps: intermittently transporting open-ended bags to a sealing station; positioning the sealed end of filled bags against an adjustable guide means; advancing the bags continuously through the sealing station in evenly spaced intervals; holding the horizontal lips in an open position parallel to each other; tucking in each of the vertical lips to form an upper and lower horizontal flap while said horizontal lips are held in said open position; applying adhesive to the side tucks and on an outer surface of the folded-over, upper horizontal flap; and gradually folding and pressing the upper flap down onto the side tucks and the bottom flap up on top of the upper flap; wherein the steps of holding the horizontal lips, tucking, applying adhesive, and folding are performed in sequence at respective stations along a continuous production line.

Other objects, features and advantages of the present invention will be apparent when the detailed description of the preferred embodiments of the invention are considered in conjunction with the drawings which should be construed in an illustrative and not limiting sense as follows.

DETAILED DESCRIPTION OF THE PREFERRED EMBODIMENTS

Figure 1:
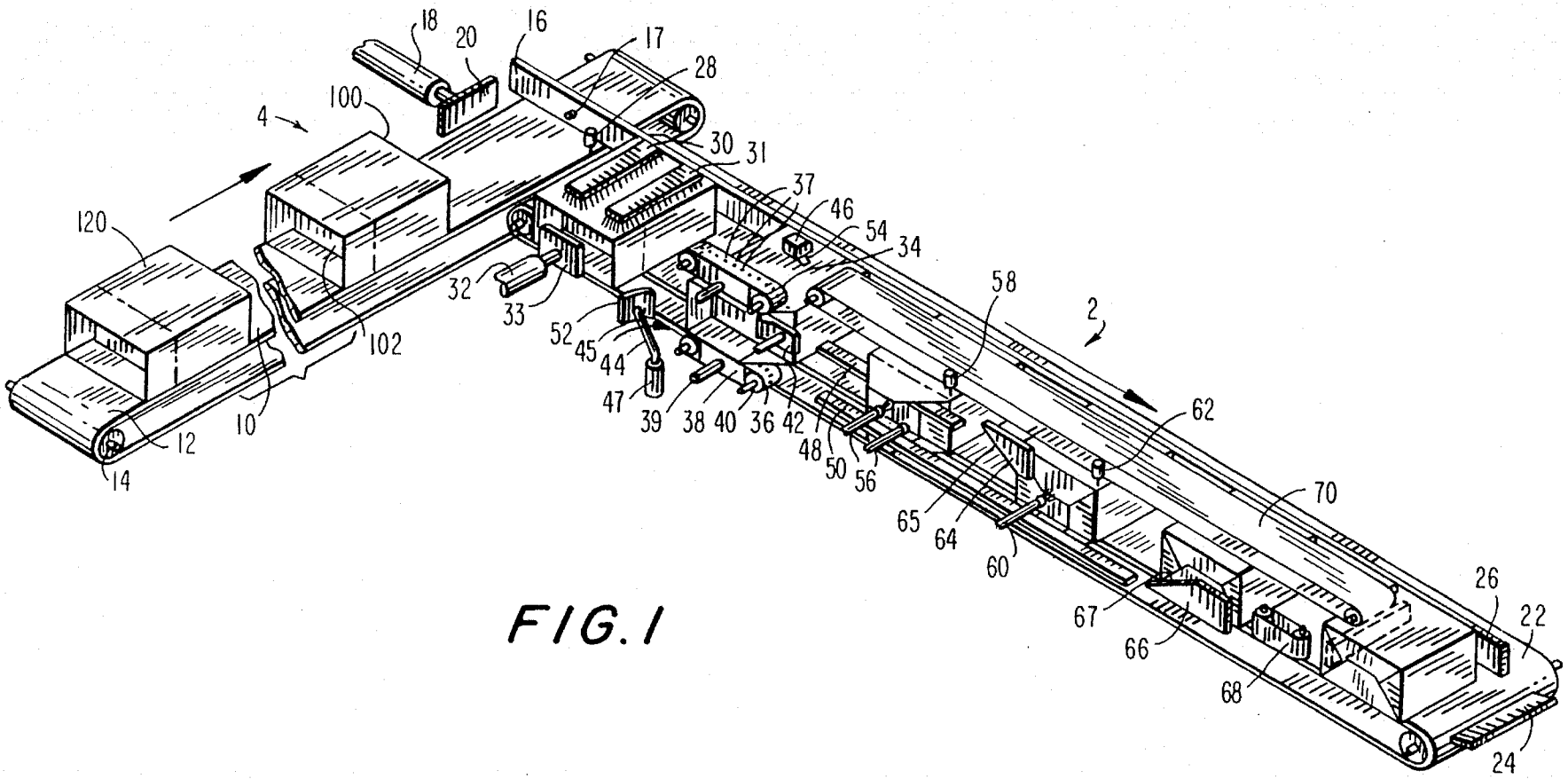
FIG. 1 is a concept drawing showing a perspective view of the bag sealing apparatus in accordance with a preferred embodiment of the invention.

For purposes of the description, it will be assumed that the elements packaged are diapers, although it will be understood that other elements may be packaged and sealed by a sealing apparatus in accordance with this invention. Further, any conventional paper-based packaging which has been assembled in a square or rectangular configuration having one sealed end 100 and one open end 102 may be sealed by the bag sealing apparatus of the invention. A suitable type bag 120 is shown on the sealing apparatus in FIG. 1 and in FIG. 10. When the bag is filled with diapers 122 or any other product, the open end 102 has top and bottom horizontal lips 104, 106 and leading and trailing vertical lips 108, 110 extending past the diaper fill line 112.

FIG. 1 shows the bag sealing apparatus in accordance with a preferred embodiment of the invention. The apparatus includes two stations: a sealing station 2 and a transporting station 4 for transporting filled diaper bags 120 directly off of an existing diaper manufacturing line (not shown) to the sealing station 2. The components of the transporting station 4 are an infeed conveyor means, an adjustable stopping means and a transfer means. The components of the sealing station 2 are an adjustable guide rail, bag advancing means, alignment means, vacuum means, side tucking means, control means, adhesive application means, folding means and pressing means.

The infeed conveyor means comprises a conveyor 10 having a conventional structure. The conveyor 10 is supported by a side structure (not shown) comprising flat-stock steel (carbon) beams and a plurality of leg supports (not shown) comprising angle iron and having steel foot pads. A flat nylon belt 12 is driven by a standard motor-reducer configuration (not shown) around a pair of drums 14 located at entry and exit ends of conveyor 10. A plurality of take-up or tension rollers (not shown) are spaced between the end drums 14 to provide additional support to the belt 12.

The stopping means comprises a stop bar 16 located at the exit end of conveyor 10. The stop bar 16 is adjustable in the same direction of conveyor movement (shown by an arrow alongside conveyor 10). A first photoeye 17 is attached to the stop bar and pointed to look down the infeed conveyor 10 at the sealed ends 100 of the approaching packages 120. The transfer means comprises a push piston 18 having a flat plate 20 at its end. Motive force is provided to the push piston 18 by pressurized air (i.e. it is a pneumatic piston). The push piston 18 is arranged in a perpendicular direction at the exit end of conveyor 10 such that the flat plate 20 can contact the side of a bag 120 and push it from the infeed conveyor 10 to bag advancing means of the sealing station 2.

The bag advancing means of sealing station 2 comprises a flighted conveyor 22 having a support structure (not shown) similar to that of infeed conveyor 10 and running perpendicular thereto. The flighted conveyor 22 is equipped with plastic flights 24 at regular intervals on the outer periphery of its belt. This conveyor is sprocket driven which prevents the belt from slipping and the speed from varying. An adjustable guide rail 26 disposed in a vertical direction is provided to engage the sealed end 100 of each bag 120 as it is advanced on the flighted conveyor 22. As shown in FIG. 1, guide rail 26 comprises an extension or continuation of stop bar 16 which extends the length of the flighted conveyor 22. Alternatively, the stop bar 16 and the guide rail 26 may comprise two separate adjustable pieces, which must then be aligned with each other. A second photoeye 28 is arranged to look in a vertical direction down between the infeed conveyor 10 and the flighted conveyor 22 to sense flights 24.

The alignment means at the entry end of the flighted conveyor 22 comprises a pair of brushes 30, 31, which act in conjunction with a second pneumatic push piston 32 and the guide rail 26. Both brushes 30, 31 are disposed above and parallel to the flighted conveyor 22 and in contact with the top surface of the advancing bags 120, the first brush 30 being disposed at a location near the intersection between the infeed conveyor 10 and the flighted conveyor 22. The second push piston 32 is arranged perpendicular to the flighted conveyor 22 and has a flat plate 33 disposed in a vertical direction at its end. The flat plate 33 is of a size which can fit within the open end 102 of an advancing bag 120.

The side tucks are formed in a section comprising both the vacuum means and side tucking means. The vacuum means comprises a pair of vacuum conveyors 34 each having a flat, perforated belt 36 driven around a pair of drums 40 and a vacuum box 38 disposed between the drums 40. The vacuum conveyors 34 are arranged in a horizontal direction parallel to one another and are spaced apart to allow the horizontal lips 104, 106 of the open end 102 of each bag 120 to pass therebetween. Each vacuum box 38 is connected to a vacuum source (not shown) via a hose 39 which provides suction to the box 38 and through the perforations 37 in the belt 36.

The side tucking means comprises a stationary tuck bar 42 for tucking the leading vertical lip 108 of a bag's open end 102, a rotatable tuck bar 44 for tucking the trailing vertical lip 110 and a limit switch 46 for sensing when the bag is in position for the rotatable tuck bar 44 to swing clockwise and tuck in the trailing vertical lip 110. The stationary tuck bar 42 comprises a vertical section 42 located near the end of vacuum conveyors 34, and top and bottom horizontal sections 48, 50 disposed beyond the edge of the flighted conveyor 22 to allow interaction with the tucked in lips of the bag's open end 102. The rotatable tuck bar 44 comprises a horizontal shaft 45 rotatable about a vertical axis 47 at one end and having a tuck paddle 52 at the other end for tucking in the trailing vertical lip 110. The vertical axis 47 is located such that when the tuck paddle 52 is rotated clockwise, it is between the vacuum conveyors 34. A lever 54 is connected to the limit switch 46 disposed above the bags. The lever 54 hangs down so that it will contact the top surface of a bag 120 and be lifted as the bag passes thereunder.

The adhesive application means comprises a pair of glue nozzles 56 disposed in a horizontal direction, perpendicular to the flighted conveyor 22 for applying glue to the side tucks 124. Glue nozzles 56 are controlled by photoeye 58 disposed above the bags 120 and looking vertically down thereon. Another glue nozzle 60 is arranged in a similar fashion to the pair of glue nozzles 56, except glue nozzle 60 is located after the first folding plate 64 to apply glue to the folded over top flap 126. Another photoeye 62 is located above the advancing bags 120 after the first folding plate 64 and looking down thereon to control glue nozzle 60.

The folding means comprises two vertical folding plates 64, 66. The first vertical folding plate 64 has a declining leading edge 65 and is disposed such that edge 65 is above the top flap 126. The second vertical folding plate 66 has an inclining leading edge 67 and is disposed such that edge 67 is below the bottom flap 128.

The pressing means comprises a vertically disposed conveyor 68 located directly after the second vertical folding plate 66 so that the conveyor's belt applies pressure to the bag's folded over lips 152 of the open end 102 before exiting the sealing station 2. An adjustable top conveyor 70 is also provided above the advancing bags parallel to the flighted conveyor 22 to prevent the bags from skewing during the sealing process. An additional horizontal conveyor may be added at the exit end of the sealing apparatus 2 for transporting the sealed bags 150 to a manual packing table or automatic case packing machine for shipping.

Sequence of Operations

Figures 10, 11:
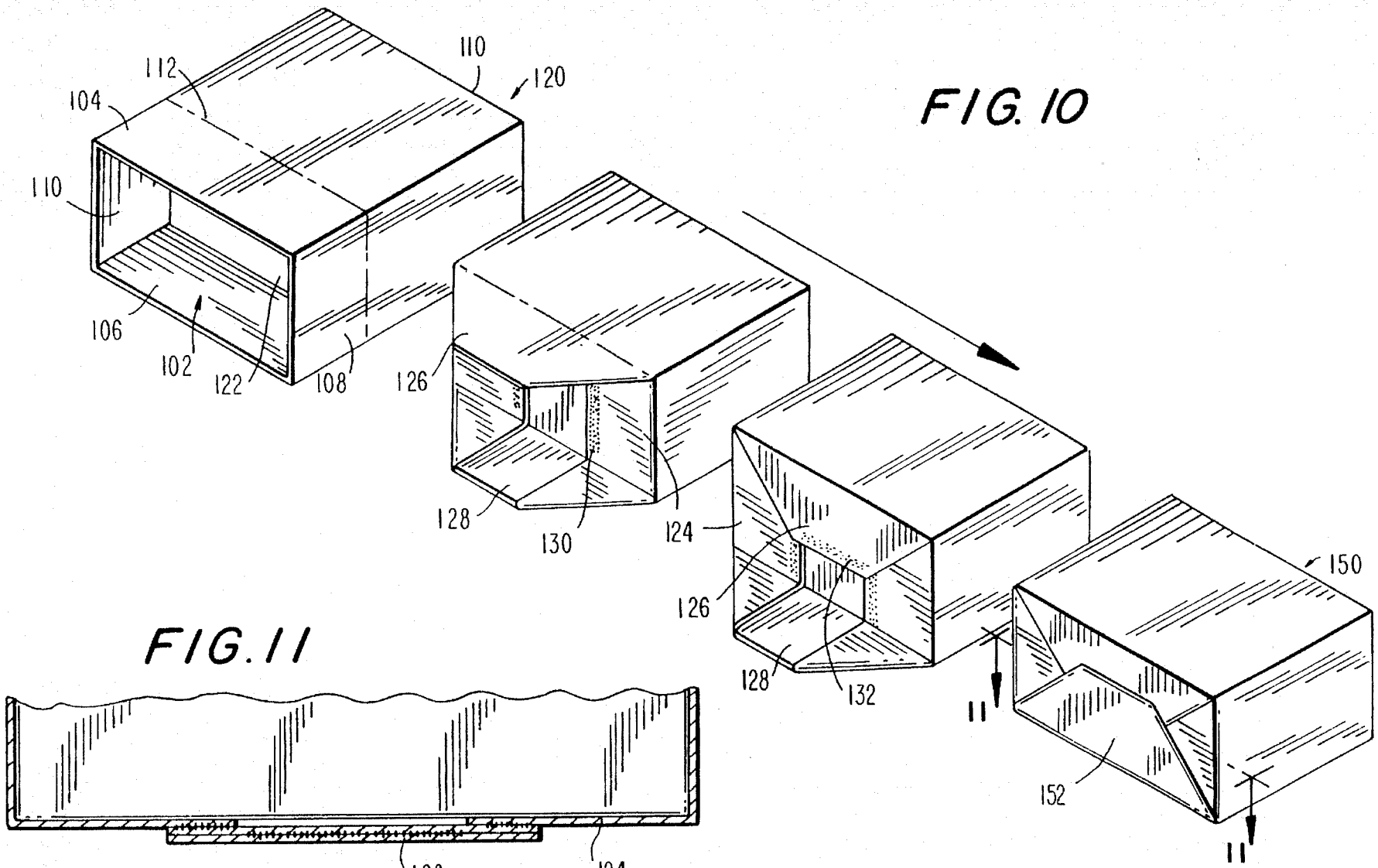
FIG. 10 is an illustration showing a series of bags during each stage of folding and sealing in accordance with invention.
FIG. 11 is a vertical cross-sectional view of a completely sealed bag in accordance with the invention taken along the line 11—11 in FIG. 10.

Referring to FIG. 10, the bag sealing apparatus of the present invention takes an open ended and filled diaper bag 120 either directly from an existing diaper production and packaging line or manually and transports it to an automatic and continuous sealing station 2. In the sealing station, the vertical lips 108 and 110 are tucked in to form top and bottom horizontal flaps 126, 128. Adhesive 130 is applied to the outer surface of the tucked in sides 124 and the top flap 126 is folded down and sealed to the side tucks 124. Additional adhesive 132 is then applied to the outer surface of top flap 126 and the bottom flap 128 is folded up and adhered to the top flap 126 to complete the sealing process. All of these functions are accomplished automatically by controlling the bag sealing apparatus with a programmable logic controller (PLC), which uses a plurality of sensors (e.g. photoeyes and limit switches) to monitor the position of the bags and signal the PLC when certain functions (i.e. pushing, side tucking, aligning, applying glue) should be activated. The PLC used with the present invention is the SLC150 PLC commercially available from Allen Bradley, Milwaukee, Wis.

After bags are filled with diapers on existing diaper production and packaging lines, the filled bags 120 are loaded onto the infeed conveyor 10 either manually or the infeed conveyor can be placed in-line with an existing diaper production line. The bags are placed on the conveyor such that their sealed end 100 is the first end to reach the exit end of the infeed conveyor 10.

A photoeye 17 senses when the bag 120 is at or near the stop bar 16 and signals the PLC. A second photoeye 28 looks down between the infeed conveyor 10 and the flighted conveyor 22 to sense when a flight 24 is coming around the drum at the entry position of the sealing station 2 and signals the PLC when the belt 22 is clear. If the first photoeye 17 senses the presence of a bag and the second photoeye 28 senses the presence of a flight 24, then the PLC will momentarily stop the infeed conveyor 10 until the flight 24 on the continuous flighted conveyor 22 has passed. The PLC will then activate push piston 18 to transfer the bag to the flighted conveyor 22 and then retract, as well as restart the infeed conveyor 10.

Figure 3:
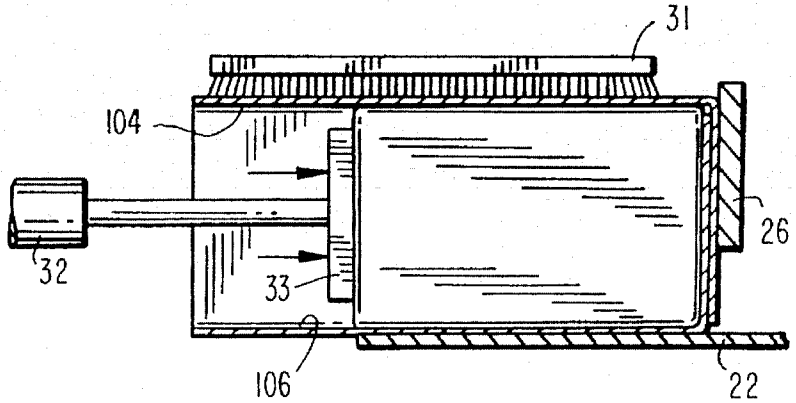
FIG. 3 is a vertical cross-sectional view of the bag sealing apparatus of FIG. 1 showing a preferred alignment means in accordance with the invention after alignment.
Figure 2:
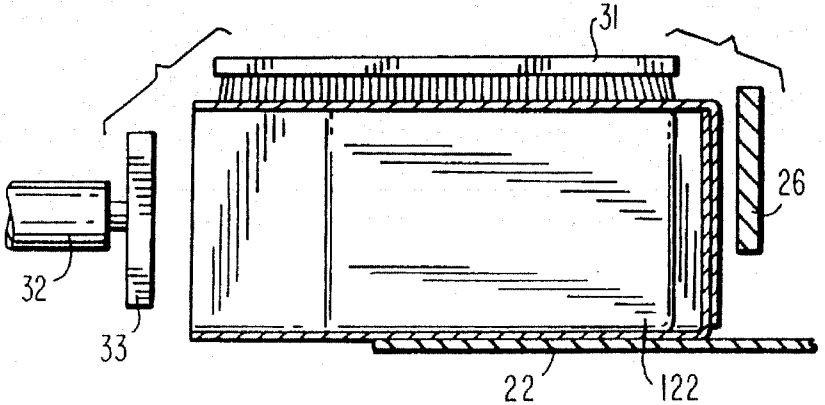
FIG. 2 is a vertical cross-sectional view of the bag sealing apparatus of FIG. 1 showing a preferred alignment means in accordance with the invention prior to alignment.

Referring to FIGS. 1–3, a first brush 30 is provided to maintain control of the bags 120 when they are transferred to the flighted conveyor 22. After the bag is transferred, it must be positioned squarely on the flighted conveyor 22 with the open end's lips 104, 106, 108 and 110 extending beyond the edge of the flighted conveyor 22. This is accomplished by pushing the bag back with a second push piston 32 so that its sealed end 100 lies squarely against the back guide rail 26. This position is maintained by the second brush 31 until a flight 24 on the conveyor 22 engages the bag and advances it forward. Since the flighted conveyor 22 travels continuously and at a constant rate, there is no need for an additional sensor to signal the PLC when the bag is in front of push piston 32. The PLC simply activates push piston 32 at a certain time after the bag is transferred onto the flighted conveyor 22.

Figure 4:
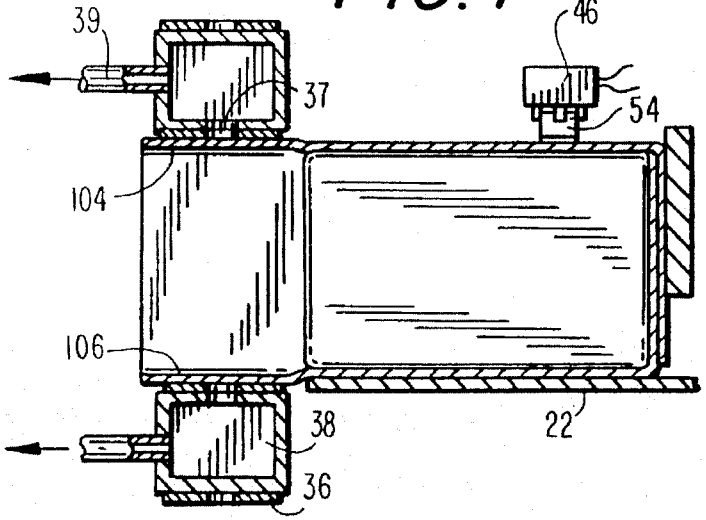
FIG. 4 is a vertical cross-sectional view of the bag sealing apparatus of FIG. 1 showing a preferred vacuum means in accordance with the invention.

Once aligned, the bag is in constant motion through the sealing station 2, first advancing to a vacuum section where the open end 102 of the bag passes between upper and lower vacuum conveyors 34. Suction is continually provided to force the top and bottom horizontal lips 104, 106 open against the perforated belts 36 and to hold them in this open, parallel position while the vertical lips 108, 110 are tucked in. See FIG. 4.

Figure 5:
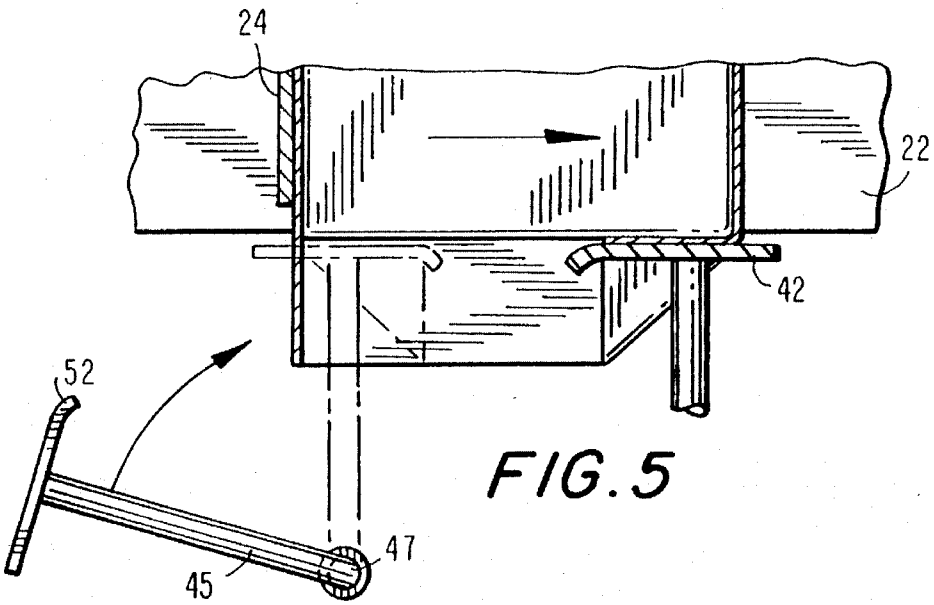
FIG. 5 is a horizontal cross-sectional view of the bag sealing apparatus of FIG. 1 showing a preferred side tucking means in accordance with the invention.

FIG. 5 shows the side tucking bars. Stationary tucking bar 42 begins to tuck the leading vertical lip 108 when the leading lip 108 reaches the end of the vacuum conveyors 34. A limit switch 46 has a lever 54 which is lifted by contact with the top surface of the bag to signal the PLC that a bag is in the side tucking section. A timing circuit in the PLC then activates the rotatable tuck bar 44, which rotates clockwise around its axis 47 approximately 90 degrees to tuck the trailing vertical lip 110 and instantly returns to its original position. Since the top and bottom lips 104, 106 are held in the open position during the side tucking process, top and bottom horizontal flaps 126, 128 and side tucks 124 are formed having precise folds. These folds are maintained by the top and bottom sections 48, 50 of the stationary tuck bar 42. An adjustable upper conveyor 70 running parallel to the flighted conveyor 22 and running the remaining length of the flighted conveyor is then provided above and in contact with the bags to apply pressure to the upper surface of the bags to maintain the squared bag position and prevent the bags 120 from skewing.

Figure 6:
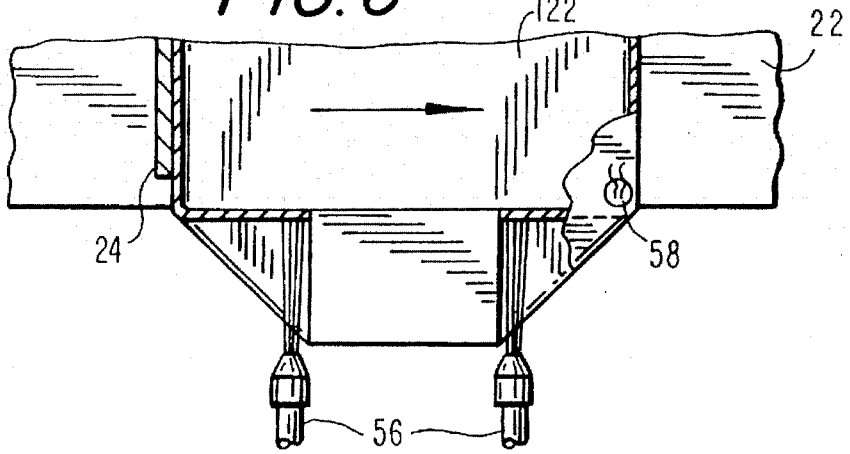
FIG. 6 is a horizontal cross-sectional view of the bag sealing apparatus of FIG. 1 showing a preferred glue application means in accordance with the invention.

Next, adhesive is applied to the outer surface of the side tucks 124. A third photoeye 58 senses the presence of a bag in the first adhesive application section, which is before the top and bottom flaps 126, 128 are folded. The PLC is signalled by photoeye 58 and glue nozzles 56 are activated to apply beads of hot-melt glue in a vertical line 130 to each side tuck 124. See FIG. 6.

Figure 7:
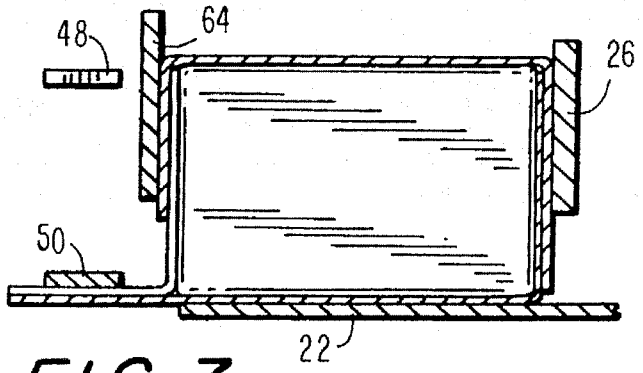
FIG. 7 is a vertical cross-sectional view of the bag sealing apparatus of FIG. 1 showing a preferred top flap folding means in accordance with the invention.
Figure 9:
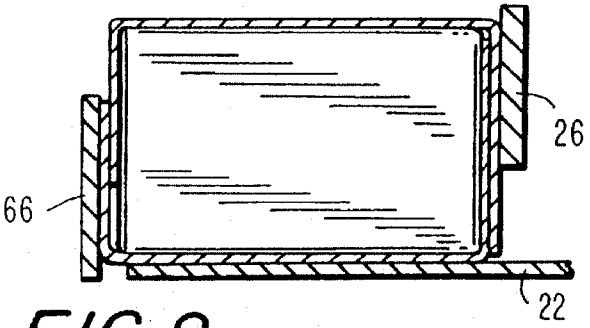
FIG. 9 is a vertical cross-sectional view of the bag sealing apparatus of FIG. 1 showing a preferred bottom flap folding means in accordance with the invention.

Referring to FIGS. 1 and 7, the top flap 126 is gradually folded down onto the side tucks 124 and adhered thereto by the vertical lines of hot-melt adhesive 130. This is accomplished by a first vertical folding plate 64 having a declining leading edge 65. The top flap 126 first contacts the folding board 64 at its uppermost point where it is gradually guided down by the declining edge 65 until the flap is flat against the side tucks 124.

Figure 8:
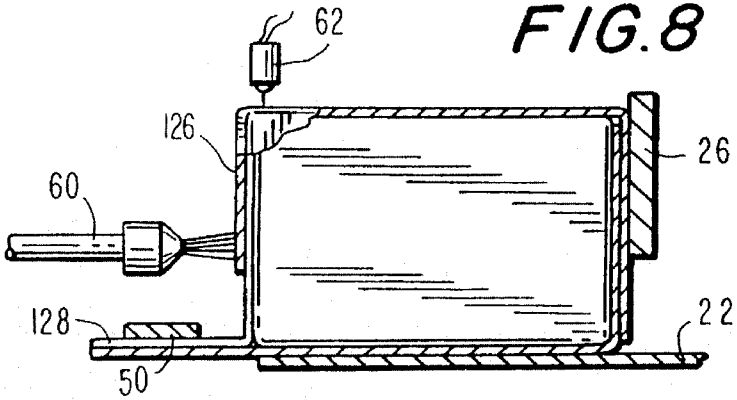
FIG. 8 is a vertical cross-sectional view of the bag sealing apparatus of FIG. 1 showing a second preferred glue application means in accordance with the invention.

Referring to FIGS. 1 and 8, a fourth photoeye 62 senses the presence of a bag in the second adhesive application section and signals the PLC to activate glue nozzle 60. Glue nozzle 60 applies beads of hot-melt glue in a horizontal line 132 to the outer surface of the folded over top flap 126. The bottom flap 128 is then gradually lifted by the second vertical folding board 66. This folding board has an inclining leading edge 67 which gradually bends the bottom flap 128 up and presses it against the top flap 126. The two flaps are adhered together by the horizontal glue line 132.

To complete the sealing process, a final vertical conveyor 68 acts to provide more pressure to the newly folded and sealed side, ensuring proper sealing of the bags.

The apparatus is adjustable to provide bag sealing capabilities for a broad range of bag sizes. First, bags having the same length and height, but different widths can be run through the apparatus without any adjustments. To accommodate bags having varying lengths, the only necessary adjustment is to the guide rail 26. The sealed ends 100 of the bags must travel through the sealing station against the guide rail 26 and the lips 104,106, 108, 110 must hang over the opposing edge of the flighted conveyor 22. If the stop bar is separate from the guide rail, it too must be adjusted to accommodate bags having different lengths. Bags having differing heights can be easily accommodated by adjusting the height of the top conveyor. After the bags are sealed, another conveyor may be added to transport the sealed bags to a manual or automatic shipping location.

Although the invention has been described with reference to certain preferred embodiments, it will be appreciated that it would be obvious to one of ordinary skill in the art of bag sealing that the preferred embodiments could be readily modified to meet specific conditions not disclosed here. For example, the photoeyes and limit switches can be interchanged or any other conventional sensing devices may be used. The adhesive need not be hot-melt glue, but rather may be cold-melt or a heat activated adhesive strip may be used. Further, bags made of paper or plastic may be sealed with the apparatus and method of this invention and the top and bottom flaps may be folded up or down in any order. All such variations and modifications are intended to be within the scope and spirit of the invention as defined in the claims appended hereto.

We claim:

1. An apparatus for sealing bags having an open end, the open end having a pair of horizontal lips and a pair of vertical lips, comprising:

advancing means for advancing the bags;

guide means for positioning the bags on said advancing means;

vacuum means for holding the horizontal lips in an open position, wherein said vacuum means comprises a pair of horizontal conveyors in spaced and parallel relation such that the open end of each of the bags passes continuously therebetween, each of said horizontal conveyors having a perforated belt through which a vacuum source applies suction to an outer surface of each of the horizontal lips; and side tuck means for tucking in each of the vertical lips while the horizontal lips are held in said open position to form a pair of side tucks and an upper and lower horizontal flap.

2. An apparatus for sealing bags having an open end for use in line with a bag filling machine, the open end having a pair of horizontal lips and a pair of vertical lips, comprising:

infeed conveyor means for intermittently conveying each one of the bags in turn to a sealing station;

advancing means for continuously advancing the bags through said sealing station;

guide means for positioning the bags on said advancing means;

vacuum means for holding the horizontal lips in an open position, wherein said vacuum means comprises a pair of horizontal conveyors in spaced and parallel relation such that the open end of each of the bags passes continuously therebetween, each of said horizontal conveyors having a perforated belt through which a vacuum source applies suction to an outer surface of each of the horizontal lips; and side tuck means for tucking in each of the vertical lips while the horizontal lips are in said open position to form side tucks and an upper and lower horizontal flap.

3. The apparatus as defined in claim 2, wherein the bags have a sealed end, the apparatus further comprising alignment means for maintaining control of the bags and aligning the sealed end against said guide means, said guide means being adjustable for accommodating bags of various sizes, said alignment means comprising a brush having bristles which contact a top surface of the bags and a pushing means for pushing the bags against said adjustable guide means.

4. A method for sealing bags having an open end, the open end having a pair of horizontal lips and a pair of vertical lips, comprising the steps of:

advancing the bags continuously through a pair of horizontal conveyors in spaced and parallel relation such that the Open end of each of the bags passes therebetween, each of said conveyors having a perforated belt;

applying suction through said perforated belt of each of said conveyors to an outer surface of each of the horizontal lips, such that the horizontal lips are held in an open position; and tucking in each of the vertical lips while the horizontal lips are held in said open position by said perforated belt to form side tucks and an upper and lower horizontal flap.

5. The method as defined in claim 4, further comprising the steps of:

applying an adhesive in a vertical line on each of said side tucks and in a horizontal line on an outer surface of said Upper horizontal flap;

gradually folding and pressing said upper horizontal flap down against said side tucks and said lower horizontal flap up against said outer surface of said upper horizontal flap;

wherein the steps of applying suction to the horizontal lips, tucking the vertical lips, applying adhesive, and folding are performed in sequence at respective stations as the bags are advanced along a continuous sealing line.

6. The method as defined in claim 5, wherein a first one of the vertical lips is tucked in by a stationary tuck bar, the method further comprising monitoring the position of each of the bags and activating a rotatable tuck bar when suction is completely applied to the horizontal lips, such that a second one of the vertical lips is tucked in by said rotatable tuck bar.

7. The method as defined in claim 5, wherein the bags have a sealed end, the method further comprising aligning the sealed end against an adjustable guide means to maintain control of the bags.

8. The method as defined in claim 5, wherein the bags are advanced through said continuous sealing line in evenly spaced intervals.

9. The apparatus as defined in claim 1, further comprising control means for monitoring the position of each of the bags and activating said side tuck means when each of the bags has completely entered said vacuum means.

10. The apparatus as defined in claim 9, wherein said advancing means comprises a continuous conveyor means having a flighted belt for maintaining the bags in spaced relation.

11. The apparatus as defined in claim 10, wherein the bags have a sealed end, the apparatus further comprising alignment means for maintaining control of the bags and aligning the sealed end against said guide means.

12. The apparatus as defined in claim 11, wherein said alignment means comprises a brush having bristles which contact a top surface of the bags and a first pushing means for pushing the bags against said guide means.

13. The apparatus as defined in claim 10, further comprising adhesive application means for applying an adhesive on said side tucks and on an outer surface of said upper horizontal flap.

14. The apparatus as defined in claim 13, wherein said adhesive application means comprises a plurality of glue nozzles arranged such that beads of adhesive are applied to said side tucks in a vertical line and to said outer surface of said upper horizontal flap in a horizontal line.

15. The apparatus as defined in claim 10, further comprising folding means for gradually folding and pressing said upper horizontal flap against said side tucks and said lower horizontal flap against an outer surface of said upper horizontal flap.

16. The apparatus as defined in claim 15, wherein said folding means comprises a first and a second vertical folding bar, said first folding bar having a declining leading edge for folding said upper horizontal flap down, said second folding bar having an inclining leading edge for lifting said lower horizontal flap up.

17. The apparatus as defined in claim 10, wherein said guide means is adjustable for accommodating bags of various sizes.

18. The apparatus as defined in claim 10, wherein said side tuck means comprises a stationary tuck bar for folding a first one of said vertical lips and a rotatable tuck bar for folding a second one of said vertical lips.

19. The apparatus as defined in claim 12, wherein the bags are output in a series from a conventional manufacturing and bag filling line, the apparatus further comprising infeed conveyor means for intermittently conveying each one of the bags in turn to said advancing means.

20. The apparatus as defined in claim 19, wherein said infeed conveyor means comprises a belt running perpendicular to said advancing means and an adjustable stop bar aligned with said guide means, the apparatus further comprising a second pushing means for pushing the bags off of said infeed conveyor means and onto said advancing means.

21. The apparatus as defined in claim 2, further comprising control means for monitoring the position of each of the bags and activating said side tuck means when each of the bags has completely entered said vacuum means.

* * * * *